US007154495B1

(12) United States Patent
Bucklen

(10) Patent No.: US 7,154,495 B1
(45) Date of Patent: Dec. 26, 2006

(54) ANALOG INTERFACE STRUCTURES AND METHODS FOR DIGITAL DISPLAYS

(75) Inventor: Willard Kraig Bucklen, Greensboro, NC (US)

(73) Assignee: Analog Devices, Inc., Norwood, MA (US)

( * ) Notice: Subject to any disclaimer, the term of this patent is extended or adjusted under 35 U.S.C. 154(b) by 499 days.

(21) Appl. No.: 10/725,909

(22) Filed: Dec. 1, 2003

(51) Int. Cl.
*G09G 5/00* (2006.01)
*G09G 3/36* (2006.01)

(52) U.S. Cl. ..... 345/213; 348/573; 341/111; 341/155

(58) Field of Classification Search ..... 345/212, 345/213, 98, 99, 100; 348/536, 537, 572, 348/573; 341/110, 111, 155
See application file for complete search history.

(56) References Cited

U.S. PATENT DOCUMENTS 5,796,392 A 8/1998 Eglit ..... 345/213
5,847,701 A * 12/1998 Eglit ..... 345/204
5,914,728 A * 6/1999 Yamagishi et al. ..... 345/565
6,049,360 A 4/2000 Yanai et al. ..... 348/684
6,157,376 A 12/2000 Eglit ..... 345/213
6,232,952 B1 5/2001 Eglit ..... 345/134
6,320,574 B1 11/2001 Eglit ..... 345/213
6,456,340 B1 * 9/2002 Margulis ..... 348/745
6,459,426 B1 10/2002 Eglit ..... 345/213

OTHER PUBLICATIONS

Diniz, George, et al. "Bringing Displays into the Digital Future", EDN Magazine, Apr. 26, 2001, pp. 105-114.
Kim, Beomsup, et al., "A 30-MHz Hybrid Analog/Digital Clock Recovery Circuit in 2-um CMOS", IEEE Journal of Solid-State Circuits, vol. 25, No. 6, Dec. 1990, pp. 1385-1394.

* cited by examiner

*Primary Examiner*—Dennis-Doon Chow
(74) *Attorney, Agent, or Firm*—Koppel, Patrick & Heybl

(57) ABSTRACT

Structures and methods are provided for generating a digital display signal from an analog signal that is limited to $2^N$ discrete analog levels and from a synchronization signal that defines spatial order for the digital display signal. These structures and methods accurately synchronize digitizers to the analog signal and they follow from a recognition that enhanced digitizer resolution will generate code patterns which easily distinguish between correct and incorrect sampling of the analog signals. Accordingly, the digitizers quantize the analog samples into an M-bit digital display signal wherein M exceeds N.

13 Claims, 7 Drawing Sheets

ANALOG INTERFACE STRUCTURES AND METHODS FOR DIGITAL DISPLAYS

BACKGROUND OF THE INVENTION

1. Field of the Invention

The present invention relates generally to digital displays and, more particularly, to interfaces that adapt analog display signals to digital displays.

2. Description of the Related Art

The cathode ray tube (CRT) has been the standard computer-display monitor for many years. Because CRTs have generally responded to analog display signals, there currently exists an extremely large installed base of computers (more than a billion) that incorporate digital-to-analog converters (DACs) configured to generate CRT analog display signals.

Recently, digital display devices (e.g., flat-panel displays, liquid crystal displays, projectors, digital television displays and near-to-eye displays) have become increasingly popular. Although it is anticipated that all-digital interfaces will eventually become the standard interface for these displays, analog interfaces must be available for the near future because of the large existing installation base of computers.

In response to the need for both analog and digital interfaces, an open industry group known as the Digital-Display Working Group (DDWG) has developed a digital-visual interface (DVI) specification which establishes analog and digital interface standards. In particular, these standards reference the Video Electronics Standards Association (VESA) specifications for the implementation of analog interfaces.

Analog-to-digital converters (ADCs) are typically used to adapt the analog display signals to a flat-panel display. The ADCs generally include high-speed samplers that provide analog samples which the ADCs then quantize into the desired digital display signals.

In order to assure accurate analog samples, the sample clock that actuates the samplers must be extremely stable (i.e., have low jitter) and be driven with extremely accurate clock signals. For example, a 640×480 pixel display with a typical refresh rate has a pixel processing period on the order of 40 nanoseconds but a large $1280\times10^{24}$ pixel display reduces the pixel processing period to 8–9 nanoseconds. Because rise and fall times and ringing further reduce the time that each pixel's analog state is valid, it is not surprising that control of ADC samplers has been a persistent problem in analog interface structures.

BRIEF SUMMARY OF THE INVENTION

The present invention is directed to structures and methods for generating an accurate digital display signal from an analog signal. They are realized with the recognition that digitizing an analog signal, which is limited to $2^N$ discrete analog levels, with M-bit digitizers, wherein M exceeds N, will generate code patterns that easily distinguish between correct and incorrect sampling of the analog signals.

The novel features of the invention are set forth with particularity in the appended claims. The invention will be best understood from the following description when read in conjunction with the accompanying drawings.

DETAILED DESCRIPTION OF THE INVENTION

FIGS. 1 through 6 illustrate structures and methods for generating a digital display signal from an analog signal that is limited to $2^N$ discrete analog levels and from a synchronization signal that defines spatial order for the digital display signal. These structures and methods accurately synchronize digitizers with the analog signal and they follow from a recognition that enhanced digitizer resolution will generate code patterns which easily distinguish between correct and incorrect sampling of the analog signals.

Figure 1:
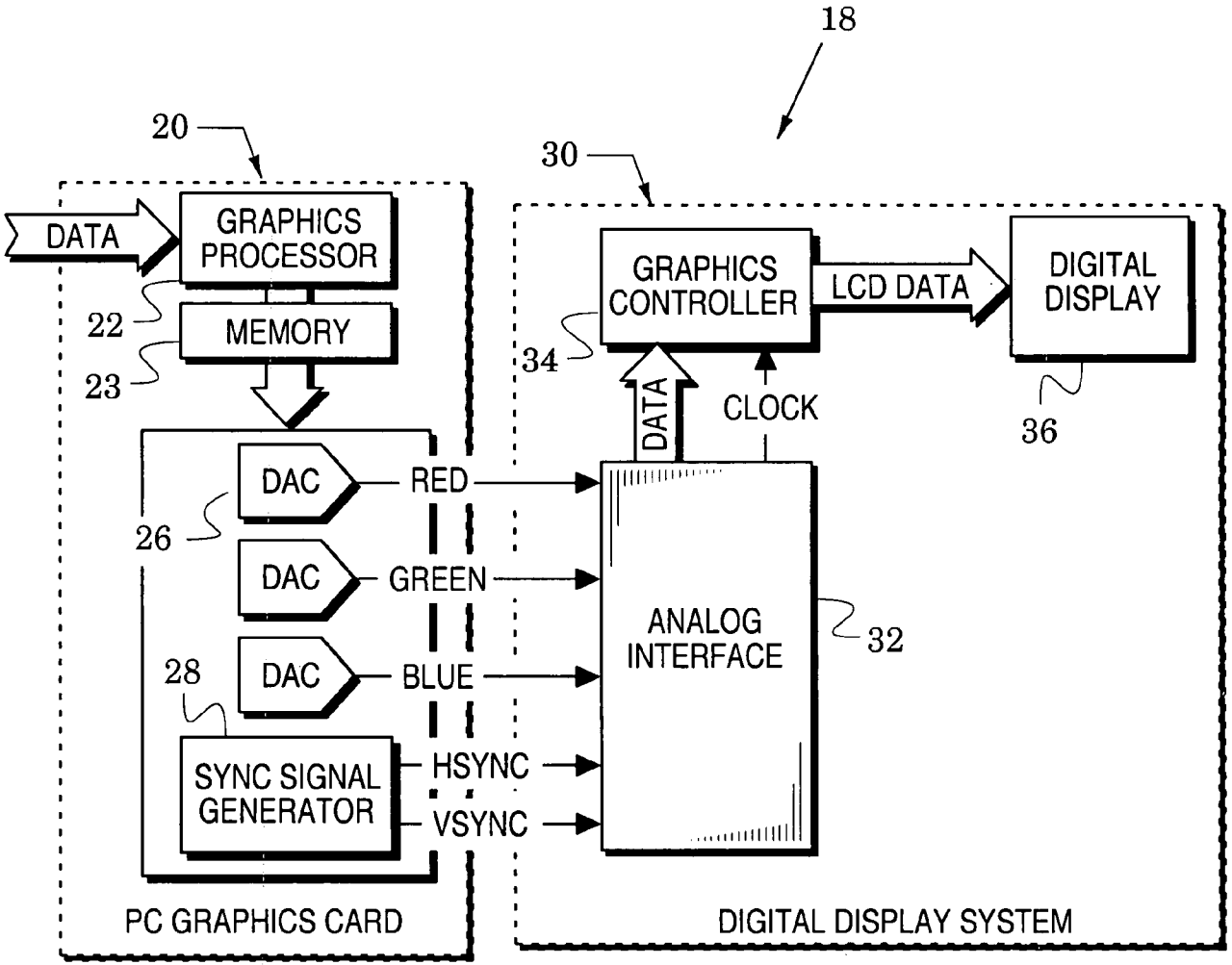
FIG. 1 is a block diagram that illustrates structure embodiments of the present invention that adapt analog display signals to drive a digital display.

In particular, FIG. 1 illustrates structure embodiments 18 of the present invention for coupling display signals from a pc graphics card 20 to a digital display system 30. The graphics card 20 includes a graphics processor 22, memory 23 and a signal converter 24. The signal converter comprises a set of digital-to-analog converters (DACs) 26 and a sync signal generator 28.

In operation of the graphics card 20, the graphics processor 22 renders data from a computer's central processing unit (not shown) into a graphics-oriented format which it stores in the memory 23. The DACs 26 are sometimes referred to as RAMDACs because they then convert elements of the stored formatted data directly from the memory 23 into analog display signals that each contain analog information (coded, for example, in 256 analog levels) sufficient to generate one of the red, green and blue components that form an analog image (e.g., on a CRT).

The sync signal generator 28 also responds to elements of the stored formatted data by generating synchronization signals that define spatial order for the analog display signals (i.e., the spatial order of display pixels). For example, these synchronization signals typically comprise a horizontal synchronization signal (hsync) that indicates the beginning of each display line and a vertical synchronization signal (vsync) that indicates the beginning of each frame of horizontal lines.

The digital display system 30 includes an analog interface 32, a graphics controller 34 and a digital display 36 which may be, for example, a liquid crystal display panel. In operation, the analog interface receives the red, green and blue analog display signals and their corresponding synchronization signals from the pc graphics card 20 and converts them to digital display signals and a corresponding clock signal. In particular, the graphics controller 34 receives these signals from the analog interface and formats them into forms suitable for display of the LCD data on the digital display 36.

Figure 2:
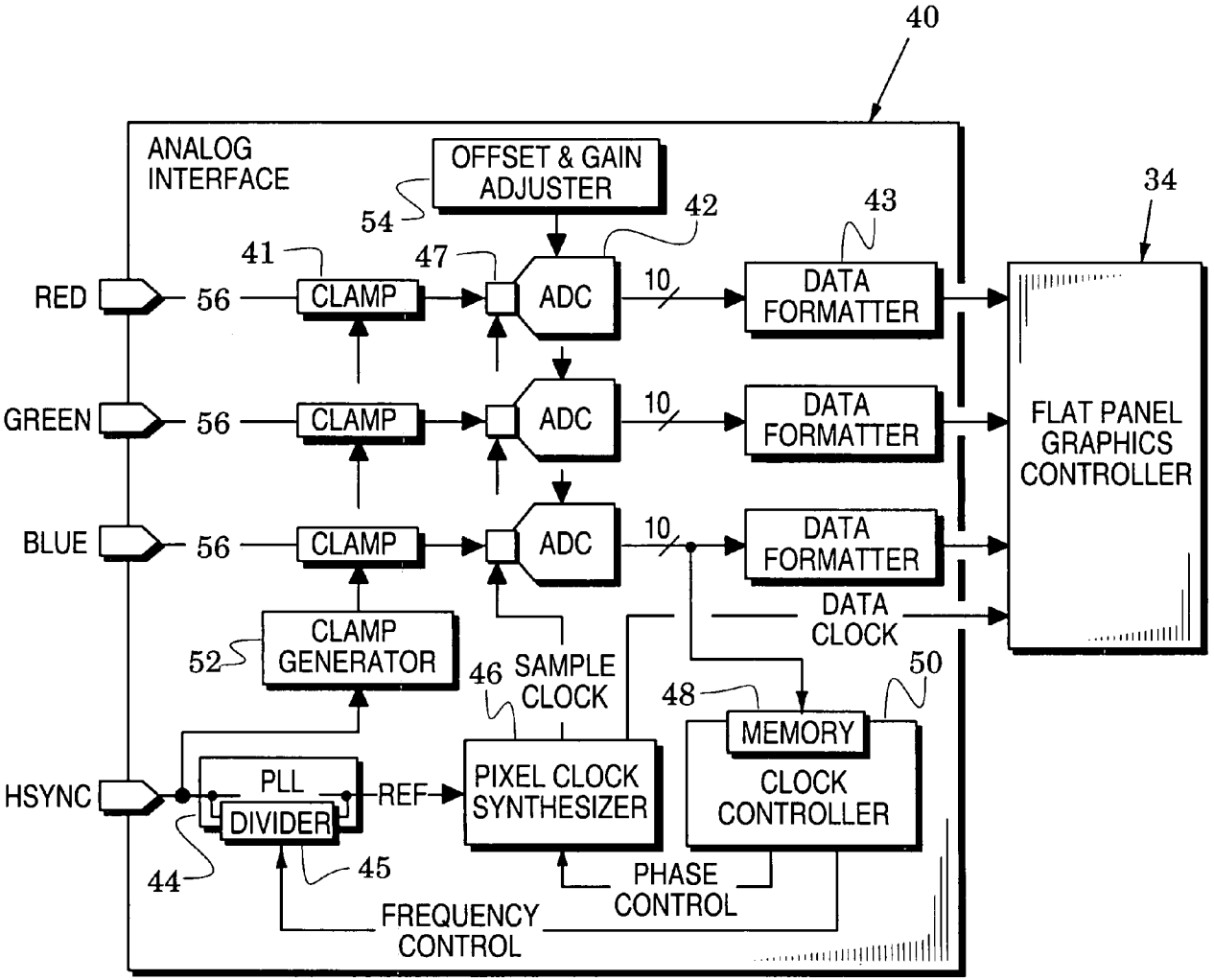
FIG. 2 is a block diagram that illustrates an analog interface in the structures of FIG. 1.

In transit to the analog interface 32, the phase relationship between the synchronization signals and the red, green and blue analog display signals is lost and this relationship must be reconstructed in the analog interface. FIG. 2 illustrates an analog interface embodiment 40 which is particularly suited for the purpose of generating digital display signals that accurately recover this synchronization as they adapt the analog display signals to Digital display 36 of FIG. 1.

In particular, the analog interface 40 includes, for each of red, green and blue analog display signals 56, an analog-to-digital converter (ADC) 42 coupled between a clamp 41 and a data formatter 43. It further includes a phase-locked loop (PLL) 44, a pixel clock synthesizer 46, a clock controller 50 and an associated memory 48, a clamp generator 52 and an offset and gain adjuster 54.

The PLL 44 provides a reference signal (REF) which it phase locks to the hsync signal that comes from the sync signal generator (28 in FIG. 1). It is intended that graphics will be displayed on the digital display (36 in FIG. 1) in a predetermined number of pixels (e.g., 1280) that are spaced across a predetermined number of lines (e.g., 1024) that form one complete graphics frame (the VSYNC signal of FIG. 1 is not shown in other figures as it is not relevant to the description).

Accordingly, the PLL includes a divider 45 that divides the reference signal so that it can be phase locked to the hsync signal. For example, if only the number of line pixels is considered and if the number is 1280, the divider 45 would be commanded to have a divisor of 1280 so that the ratio of the reference signal's frequency to the hsync signal's frequency would also be 1280. In practice, each line generally includes a blanking signal which must also be considered. In at least one exemplary super extended graphics array (SXGA) display, the divisor would be increased to something on the order of 1350 to accommodate the blanking signal. In another example, the video electronics standard association (VESA) defines a "reduced blanking" timing which permits more active pixels to be transmitted to a digital display at a given pixel frequency.

The pixel clock synthesizer 46 introduces a phase shift (e.g., a delay) to position the reference signal and thereby form a sample clock which drives wide-band samplers 47 in each of the ADCs 42. In response to the red, green and blue analog display signals 56 and to the sample clock, the samplers provide analog samples which are then quantized by the converter portions of the ADCs 42. Finally, the data formatters 43 convert the quantized signals into formats compatible with the graphics controller 34.

In order to set the black level of the ADCs properly, the clamp generator provides information as to the location of the "back porch" which is located between each hsync signal and the first pixel of the line. At this point, the clamp generator 52 commands the clamps 41 to establish a predetermined clamp level (e.g., 0 volts) for each ADC. The offset and gain adjuster 54 can be used in a conventional manner to set the offset and gain of each ADC which essentially sets the brightness and contrast of the red, green and blue pixels on the digital display (36 in FIG. 1).

As mentioned above, the phase relationship between the synchronization signals and the red, green and blue analog display signals is lost in transit to the analog interface 40 and must be reconstructed. As also mentioned above, the processing period for each pixel can be extremely limited (e.g., on the order of 8–9 nanoseconds) and the time extent of reliable pixel information is further limited by spurious signal parameters such as rise and fall times and ringing. Accordingly, setting the sample clock so that the samplers provide accurate analog samples to the converter sections of the ADCs 42 is a demanding task.

The invention recognizes that this task can be effectively accomplished by providing ADCs (42 in FIG. 2) whose conversion resolution substantially exceeds the resolution of the DACs (26 in FIG. 1) that generated the analog display signals. For example, if the DACs have a resolution of 8 bits, the ADCs may be configured with a resolution of 10 bits.

Thus, each DAC will provide 256 levels of analog signals but the ADCs will provide 1024 digital codes. This enhanced resolution is utilized by the clock controller 50 which monitors digital codes generated by at least one of the ADCs 42 and provides a frequency control signal to the divider 45 of the PLL 44 and a phase control signal to the pixel clock synthesizer 46. The monitoring is facilitated by the clock controller's memory 48 which effectively forms "code bins" for storing a count of recent occurrences of the digital codes generated by one of the ADCs 42. For 10-bit ADCs, an exemplary memory could be configured with 1024 locations that are each sufficient (e.g., 16 bits) to store a count of its respective digital code.

Figure 3:
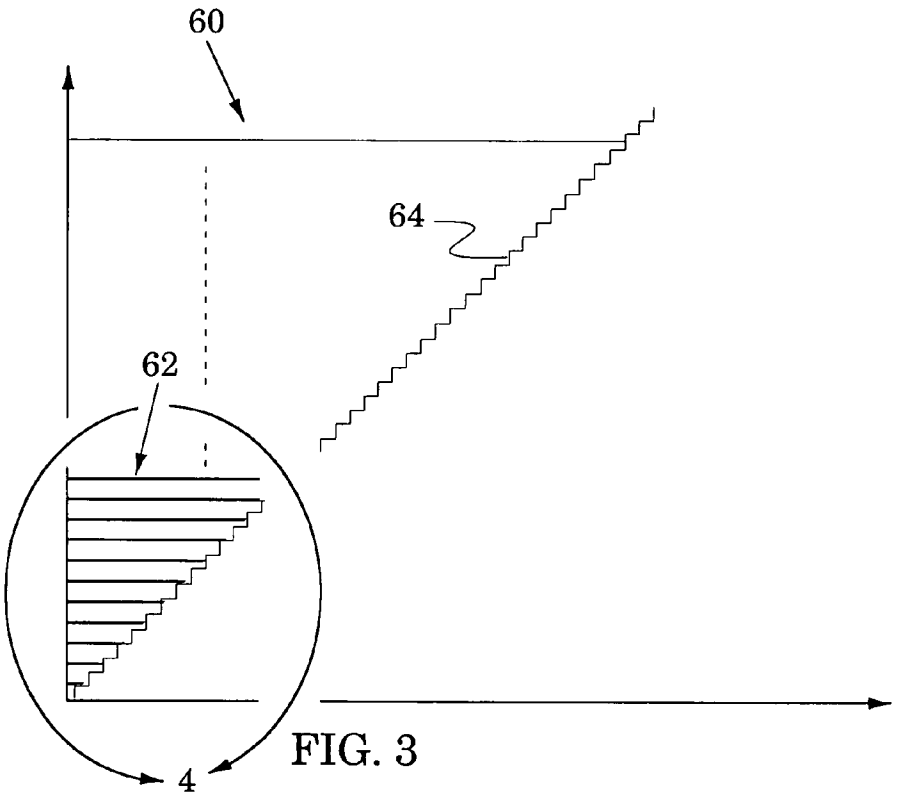
FIG. 3 is a graph of relationships between digital and analog signals in the analog interface of FIG. 2.
Figure 4A:
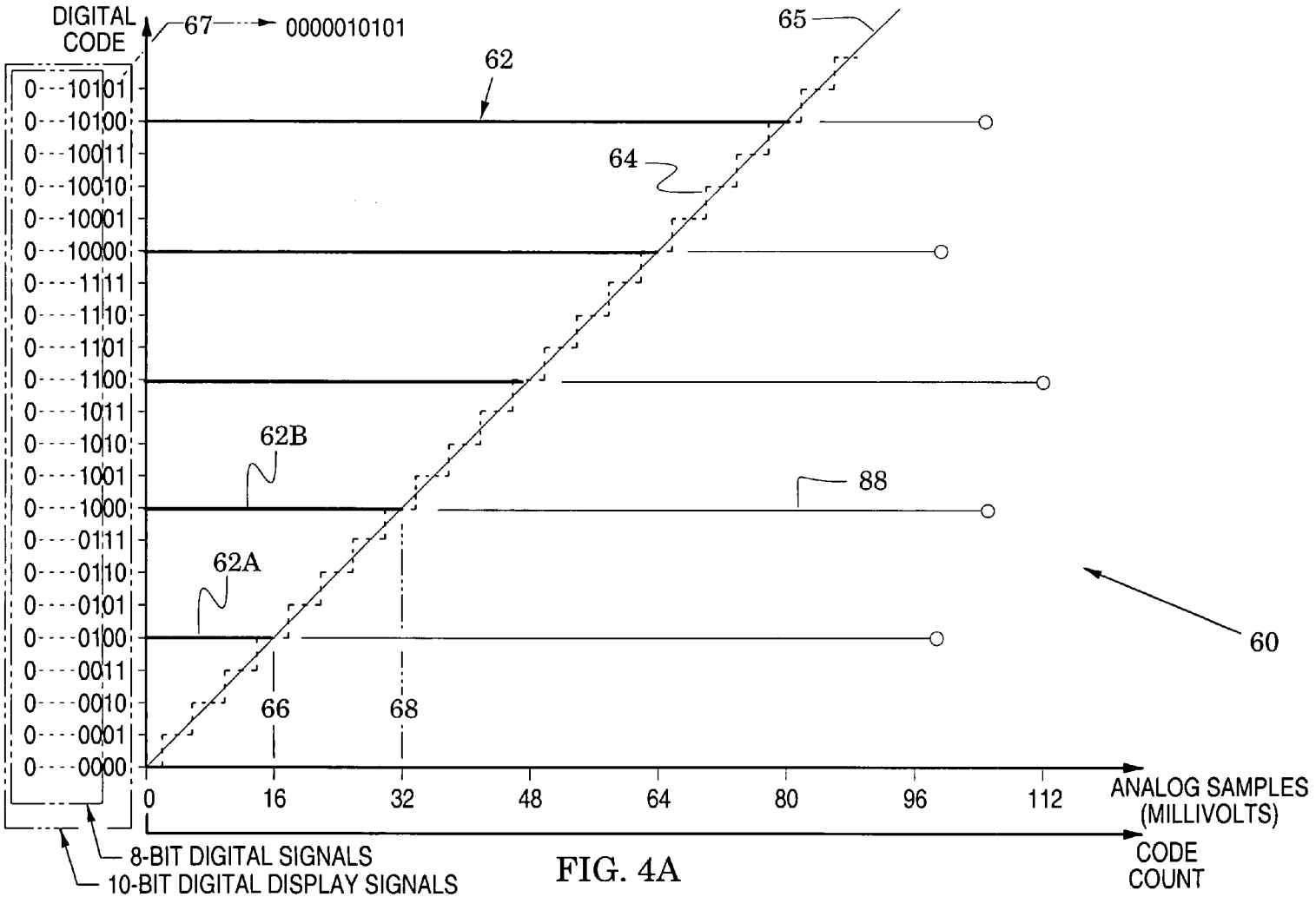
FIGS. 4A–4C are graphs that expand a portion of the graph of FIG. 3 to illustrate desired and undesired digital codes in the analog interface of FIG. 2.
Figure 4B:
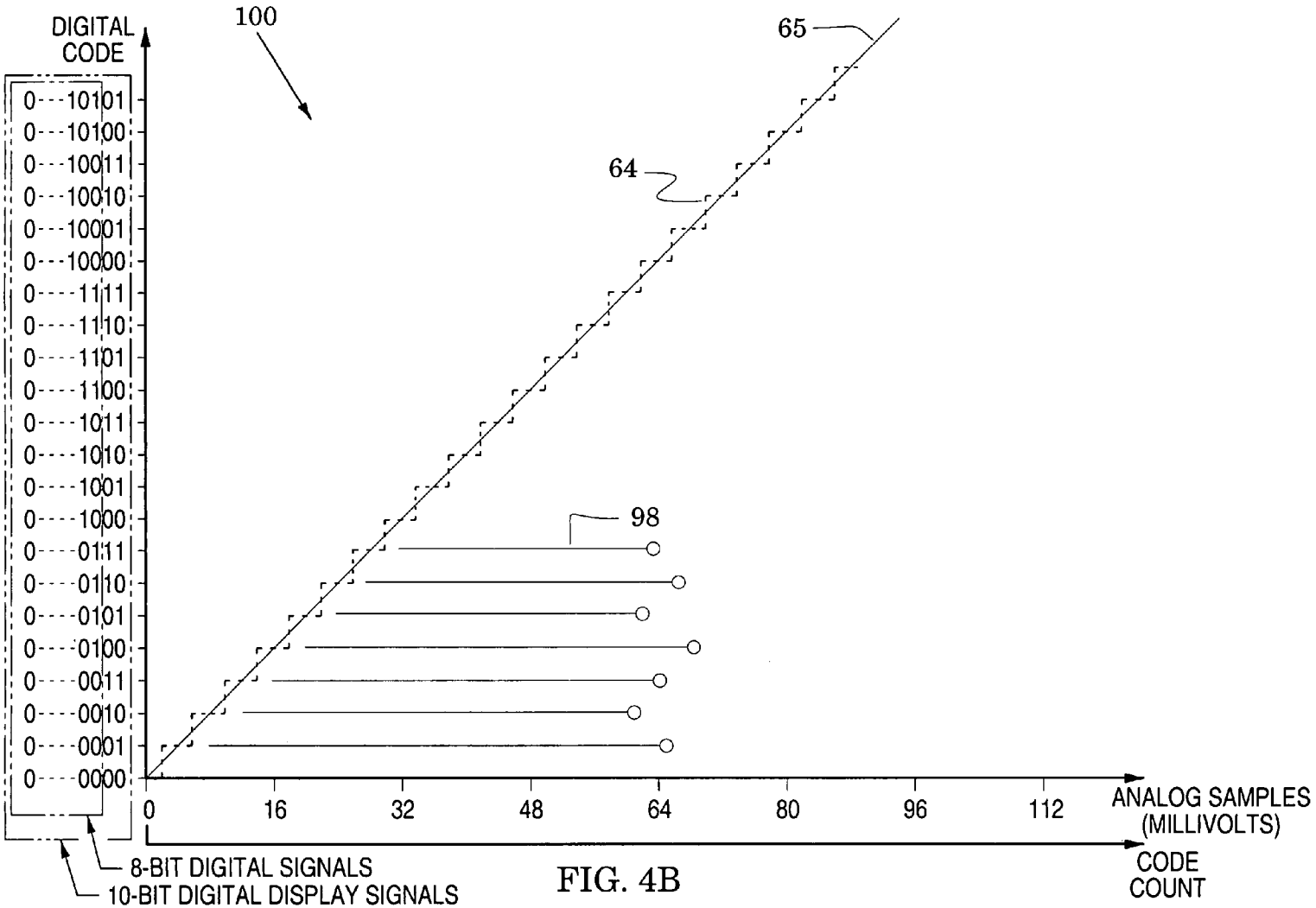
Figure 4C:
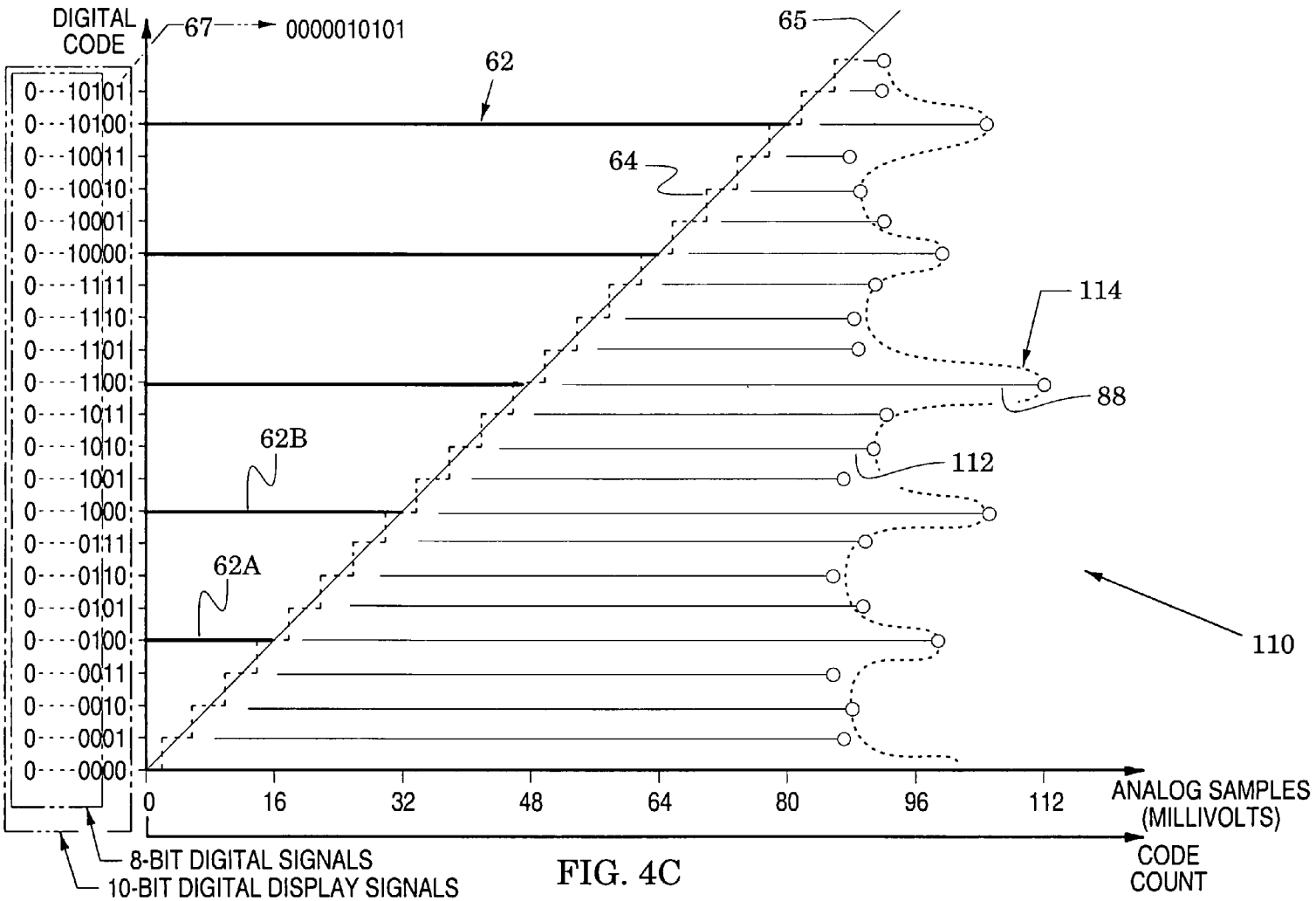

The operation of the high-resolution ADCs 42, the PLL 44, the pixel clock synthesizer 46, the memory 48 and the clock controller 50 can be examined with reference to FIG. 3 which illustrates transfer functions of the DACs 26 of FIG. 1 and the ADCs 42 of FIG. 2 and to FIGS. 4A–4C which are expanded views of the area 4 of FIG. 3. Although the following description is directed to adaptation of a selected one of the red, green and blue analog display signals of FIGS. 1 and 2, its concepts apply to all.

The graph 60 of FIG. 4A, for example, shows 8-bit digital codes along the vertical graph axis that are provided to a DAC 26 of FIG. 1 by the memory 23. The heavy horizontal bars 62 indicate the corresponding analog signals (with reference to exemplary analog amplitudes in millivolts along the horizontal graph axis) that are generated by any of the DACs 26. For example, the 8-bit digital code 0---01 corresponds to a converted analog signal of 16 millivolts.

The graph 60 also shows a stepped plot 64 which indicates the transfer function of any of the ADCs 42 of FIG. 2 in response to an analog signal along the graph's horizontal axis and the resulting ten-bit codes which are shown along the graph's vertical axis. The stepped plot 64 is centered on a broken line 65 which represents an analog-to-digital conversion which has no offset or gain errors (i.e., the offset and gain adjuster 54 of FIG. 2 has perfectly adjusted the ADCs).

In an exemplary use of the stepped transfer function 64, the horizontal bar 62A shows that an 8-bit digital code 0---01 into a DAC (26 in FIG. 1) corresponds to an analog signal of 16 millivolts and the vertical line 66 intersects the transfer function 64 to illustrate that an input analog signal of 16 millivolts corresponds to a 10-bit digital code 0---0100 from any of the ADCs (42 in FIG. 2). Similarly, the horizontal bar 62B shows that an 8-bit digital code 0---10 corresponds to an analog signal of 32 millivolts and the vertical line 68 intersects the transfer function 64 to illustrate that an input analog signal of 32 millivolts corresponds to a 10-bit digital code 0---1000 from any of the ADCs.

FIG. 3 illustrates the complete graph 60 from which a portion 4 has been expanded and shown in FIG. 4A. Some bits in the digital codes of FIG. 4A have not been shown to conserve drawing space. An arrow 67 indicates the complete code for an exemplary one of the digital codes.

The 256 analog levels of the analog display signals of the 8-bit DACs 26 of FIG. 1 correspond to the digital data received from the memory 23. The graph 80 of FIG. 5A illustrates an exemplary portion 82 of one of these analog display signals that defines various ones of these analog levels 84 which are connected by ramp segments 86. The ramp segments are shown as straight lines for illustrative purposes but represent the portion of the analog display signal used up by spurious signal parameters (e.g., rise and fall times and ringing). The ramp segments substantially reduce the temporal extent of the analog levels 84 and, accordingly, the sample clock of FIG. 2 must be positioned with significant accuracy.

Arrows 87 in FIG. 5A indicate pulses of a sample clock that is positioned so that the samplers 47 of FIG. 2 provide accurate analog signals to their respective ADCs 42. With this sampling accuracy, the ADCs 42 will only generate those 10-bit digital codes of FIG. 4A that correspond to the horizontal bars 62. Over some exemplary time span, the code bins in the memory 48 will therefore show various code counts that correspond to the horizontal bars 62 but none that correspond to the other 10-bit digital codes of FIG. 4A.

In FIG. 4A, horizontal lines terminated by circles symbolize the code counts 88 in the memory 48 of FIG. 2 with the length of the line indicative of the number of codes in each code bin. The lengths are exemplary (as they correspond to the content of each image stored in the memory 23 of FIG. 1) and are only intended to indicate that over an exemplary time span, generated digital codes will correspond to the horizontal bars 62. The graph 60 of FIG. 4A indicates that the current phase control and frequency control signals from the clock controller 50 of FIG. 2 are proper—that is, the sample clock pulses (87 in FIG. 5A) are correctly positioned to generate analog samples.

Figure 5B:
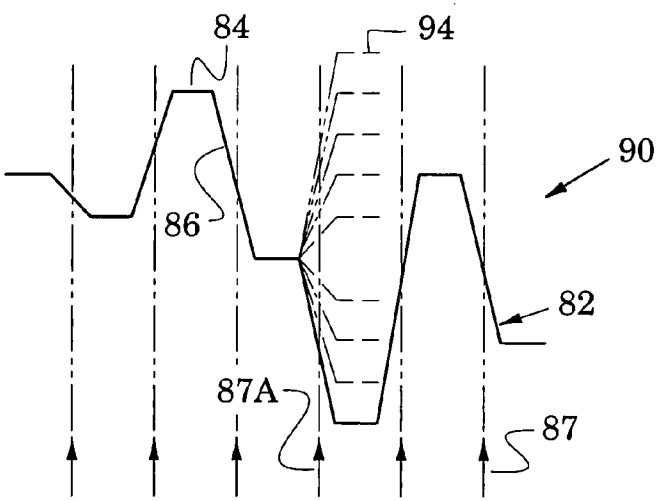
FIGS. 5A and 5B are timing diagrams that respectively illustrate desired and undesired timing of a sample clock in the analog interface of FIG. 2 which generate the desired and undesired digital codes of FIGS. 4A–4C.
Figure 5A:
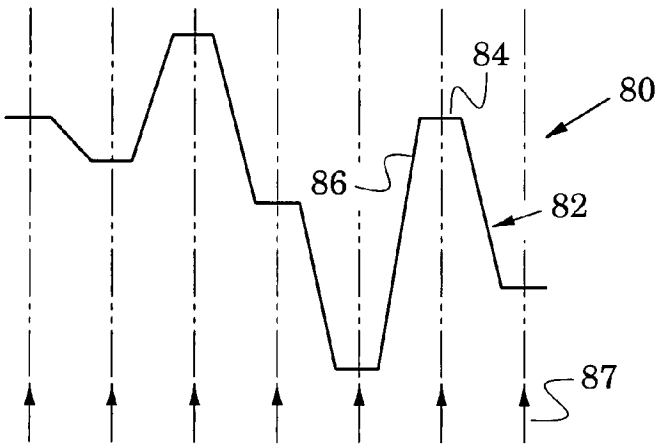

In contrast to FIG. 5A, the graph 90 of FIG. 5B illustrates a situation in which the clock pulses 87 are positioned midway between the analog levels 84 so that the samplers (47 in FIG. 2) sample the ramp segments 86. Attention is directed to the clock pulse arrow 87A and to a series of analog levels 94 that may occur just after this clock pulse (the particular levels will correspond to the data in the memory 23 of FIG. 1). Although each of the analog levels 94 correspond to one of the horizontal bars 62 of FIG. 4A, their respective ramp segments define various analog levels at the time of the clock pulse arrow 87A that, in general, do not.

The analog samples provided by the samplers (47 in FIG. 2) will no longer correspond to the end of one of the horizontal bars 62 of FIG. 4A but, rather, will be distributed along the horizontal axis of FIG. 4B. These analog samples will then be quantized in accordance with the transfer function 64 of FIG. 4B and, over an exemplary time span, be distributed among all of the 10-bit digital display signals of the vertical axis of FIG. 4B.

This process is specifically shown in the graph 100 of FIG. 4B which is similar to FIG. 4A (with like elements indicated by like reference numbers) but does not show the horizontal bars 62. Code counts 98 (in the code bins of the memory 48 of FIG. 2) are now shown that, in general, correspond to all of the 10-bit digital display signals. Again, the actual code counts will vary with the data in the memory 23 of FIG. 1.

The correct and incorrect timing of the sample clock pulses 87 in FIGS. 5A and 5B thus respectively produce the code count arrangements of FIGS. 4A and 4B that are easily distinguished because one (in FIG. 4A) corresponds only to the 8-bit digital signals along the vertical axis and the other (in FIG. 4B) corresponds to the 10-bit digital signals along the vertical axis. The difference in resolution thus provides code patterns which are easily distinguished. The clock controller 50 of FIG. 2 is configured to examine the code counts collected in its associated memory 48 and adjust the sample clock of the clock synthesizer 46 to obtain the code-count pattern of FIG. 4A which has an absence of those 10-bit digital signals that do not correspond to one of the horizontal bars 62.

In operation, the clock controller 50 adjusts the phase control signal that it sends to the pixel clock synthesizer 46 to enable phase shifts of the sample clock which will alter the code counts in the memory 48. This process is continued until the clock controller 50 senses that the code counts correspond to the horizontal bars 62 of FIG. 4A. The pixel clock synthesizer can be realized with any of various structures that provide selectable phase shifts. An exemplary synthesizer is a conventional delay-locked loop.

The graph 60 of FIG. 4A has been idealized to facilitate the initial description of the analog interface 40 of FIG. 2. Accordingly, the graph 60 ignores "real-life" effects (e.g., gain, offset and linearity errors in the ADCs 42 and general system noise) that will degrade the code counts 88 of FIG. 4A. The result of these real-life effects is shown in the graph 110 of FIG. 4C which is similar to FIG. 4A with like elements indicated by like reference numbers. In contrast, however, FIG. 4C indicates that the code counts 88 of FIG. 4A are supplemented by code counts 112 that correspond to the other code counts 98 of FIG. 4B. Correct timing of the sample clock pulses (as shown in FIG. 5A) will cause these latter code counts to be reduced. In practice, code counts that generally define an envelope 114 will be a clear indication of correct timing.

As described above, the reference signal from the PLL 44 should have a frequency that corresponds to the number of pixels that are to be displayed in each row on the digital display (36 in FIG. 1) wherein this number is appropriately modified to account for any blanking signal. Accordingly, the divider 45 of the PLL 44 should be set to provide a divisor equal to the ratio of this frequency to the hsync signal's frequency. If the divider has, instead, a divisor that is off by one (either lower or higher), the clock pulse arrows 87 of FIG. 5A will cycle once between an accurate setting and an inaccurate setting during each horizontal row of pixels in the display of the digital display (36 of FIG. 1). If the divisor is off by n, then n such cycles will occur.

The clock controller 50 is configured to detect the cycles by examining the code bins of the memory 48 and, in response, to change the frequency control signal to cause an appropriate correction in the divider 45. Although a divisor error of +1 will generate a code bin pattern substantially similar to that of a divisor error of −1, the clock controller can obtain the correct count by incrementing the count one way and then reversing the increment if that produces more cycles rather than reducing cycles. Once the frequency control signal has been adjusted to properly set the frequency of the reference signal, the phase control signal can then be set as previously described.

Figure 6:
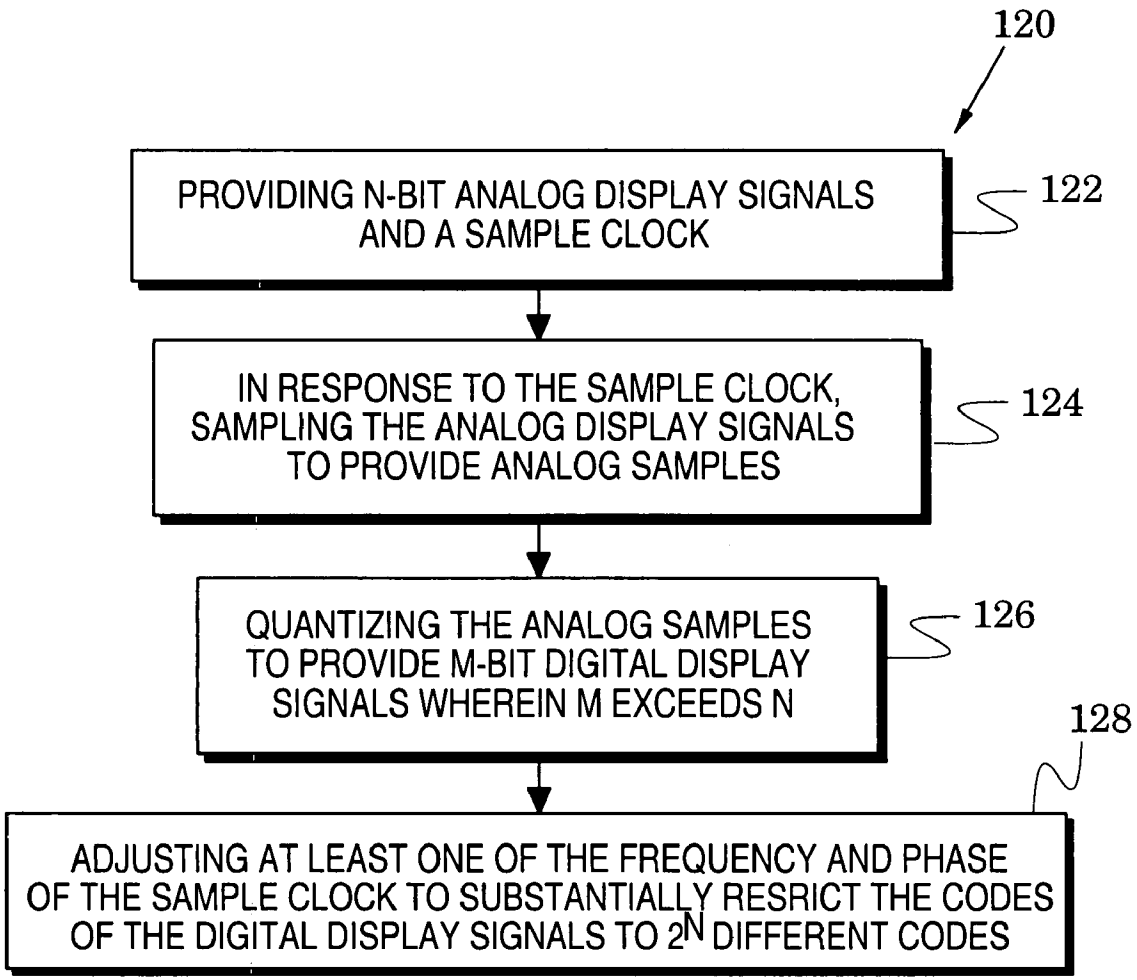
FIG. 6 is a flow chart that illustrates method embodiments of the invention which obtain the desired digital codes and the desired timing of FIGS. 4A and 5A.

The processes described above are summarized in the flow chart 120 of FIG. 6 which is directed to a method of generating a digital display signal from an analog signal that is limited to $2^N$ discrete analog levels and from a synchronization signal that defines spatial order for the digital display signal. In a first process step 122, N-bit analog display signals are provided (e.g., by the pc graphics card 20 of FIG. 1) and a sample clock is provided (e.g., by the PLL 44 of FIG. 2). As stated in process step 124, the analog signal is sampled, in response to the sample clock, to provide analog samples. This step may be accomplished with the samplers 47 of FIG. 2.

These analog samples are quantized in process step 126 to provide an M-bit digital display signal wherein M exceeds N. This step may be accomplished with the ADCs 42 of FIG. 2. Finally, at least one of the frequency and phase of the sample clock is adjusted in process step 128 to substantially restrict the codes of the M-bit digital display signal to $2^N$ different codes. This step may be accomplished with the clock controller 50 of FIG. 2 and its corresponding memory 48.

Structures and methods have been provided to synchronize digitizers with incoming analog display signals. This has been accomplished with by described observation of signals from ADCs whose conversion resolution substantially exceeds the resolution of the DACs that generated the analog display signals. Although the invention has been illustrated with an ADC resolution that exceeds the DAC resolution by two bits, embodiments include structures and methods in which the an ADC resolution exceeds the DAC resolution by at least one bit.

The clock controller 50 of FIG. 2 can be realized with various conventional structures, e.g., at least one of an array of gates, an appropriately-programmed digital processor or a combination thereof.

The structures and methods of the invention have been described with reference to a synchronization signal that comprises the hsync signal of FIGS. 1 and 2. Different pc graphics cards may provide different synchronization signals but these can be accommodated within corresponding embodiments of the invention.

The embodiments of the invention described herein are exemplary and numerous modifications, variations and rearrangements can be readily envisioned to achieve substantially equivalent results, all of which are intended to be embraced within the spirit and scope of the invention as defined in the appended claims.

I claim:

1. A method of generating a digital display signal from an analog signal that is limited to $2^N$ discrete analog levels and from a synchronization signal that defines spatial order for said digital display signal, the method comprising the steps of:

in response to a sample clock, sampling said analog signal to provide analog samples;

quantizing said analog samples to provide an M-bit digital display signal wherein M exceeds N; and adjusting at least one of the frequency and phase of said sample clock to substantially restrict the codes of said M-bit digital display signal to $2^N$ different codes.

2. The method of claim 1, further including the step of generating said sample clock in response to said synchronization signal.

3. The method of claim 1, wherein M exceeds N by at least two.

4. A method of generating a digital display signal from an analog signal that is limited to $2^N$ discrete analog levels and from a synchronization signal that defines spatial order for said digital display signal, the method comprising the steps of:

in response to a sample clock, sampling said analog signal to provide analog samples;

quantizing said analog samples to provide an M-bit digital display signal wherein M exceeds N; and adjusting at least one of the frequency and phase of said sample clock to substantially restrict the codes of said M-bit digital display signal to $2^N$ different codes;

wherein said adjusting step includes the step of:

identifying spurious codes that exceed said $2^N$ discrete analog levels; and adjusting at least one of said frequency and said phase to substantially eliminate said spurious codes.

5. A method of generating a digital display signal from an analog signal that is limited to $2^N$ discrete analog levels and from a synchronization signal that defines spatial order for said digital display signal, the method comprising the steps of:

in response to a sample clock, sampling said analog signal to provide analog samples;

quantizing said analog samples to provide an M-bit digital display signal wherein M exceeds N; and adjusting at least one of the frequency and phase of said sample clock to substantially restrict the codes of said M-bit digital display signal to $2^N$ different codes;

further including the steps of:

dividing a reference signal by a divisor to form a feedback signal;

comparing said feedback signal to said synchronization signal to thereby phase lock said reference signal to said synchronization signal; and delaying said reference signal by a delay to form said sample clock, and wherein said adjusting step includes the steps of:

changing said divisor to thereby adjust said frequency, and selecting said delay to thereby adjust said phase.

6. An analog interface which generates a digital display signal from an analog signal that is limited to $2^N$ discrete analog levels and from a synchronization signal that defines spatial order for said digital display signal, the interface comprising:

a phase-locked loop that includes a frequency divider and phase locks a reference signal to said synchronization signal via said frequency divider;

a clock synthesizer that introduces a phase shift to thereby generate a sample clock from said reference signal;

an analog-to-digital converter that includes:

a) a sampler that extracts analog samples from said analog signal in response to said sample clock; and b) at least one converter stage that quantizes said analog samples into an M-bit digital display signal wherein M exceeds N; and a clock controller that monitors said digital display signal and adjusts at least one of the divisor of said frequency divider and the delay of said clock synthesizer to substantially restrict the codes of said M-bit digital display signal to $2^N$ different codes.

7. The interface of claim 6, wherein said phase-locked loop includes:

a voltage-controlled oscillator that generates said reference signal; and a phase detector that controls said oscillator in response to phase differences between said synchronization signal and a divided signal provided by said frequency divider in response to said reference signal.

8. The interface of claim 6, wherein said clock synthesizer is a delay-locked loop.

9. The interface of claim 6, wherein said clock controller includes a memory which stores said codes.

10. An interface system for converting digital data into a digital display signal, comprising:

at least one digital-to-analog converter which converts said data to an analog signal that is limited to $2^N$ discrete analog levels;

a signal generator that provides a synchronization signal that defines spatial order in said analog signal;

a phase-locked loop that includes a frequency divider and phase locks a reference signal to said synchronization signal via said frequency divider;

a clock synthesizer that introduces a phase shift to thereby generate a sample clock from said reference signal;

at least one analog-to-digital converter that includes:

a) a sampler that extracts analog samples from said analog signal in response to said sample clock; and b) at least one converter stage that quantizes said analog samples into an M-bit digital display signal wherein M exceeds N; and a clock controller that monitors said digital display signal and adjusts at least one of the divisor of said frequency divider and the delay of said clock synthesizer to substantially restrict the codes of said M-bit digital display signal to $2^N$ different codes.

11. The system of claim 10, wherein said phase-locked loop includes:

a voltage-controlled oscillator that generates said reference signal; and a phase detector that controls said oscillator in response to phase differences between said synchronization signal and a divided signal provided by said frequency divider in response to said reference signal.

12. The system of claim 10, wherein said clock synthesizer is a delay-locked loop.

13. The system of claim 10, wherein said clock controller includes a memory which stores said codes.

* * * * *